US008578913B2

(12) United States Patent
Yoshioka et al.

(10) Patent No.: US 8,578,913 B2
(45) **Date of Patent: *Nov. 12, 2013**

(54) FUEL INJECTION APPARATUS FOR INTERNAL COMBUSTION ENGINE

(75) Inventors: Mamoru Yoshioka, Susono (JP); Fumito Chiba, Susono (JP); Takahiro Tsukagoshi, Susono (JP); Ryota Onoe, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/508,274

(22) PCT Filed: Jan. 12, 2010

(86) PCT No.: PCT/JP2010/050226

§ 371 (c)(1),
(2), (4) Date: May 4, 2012

(87) PCT Pub. No.: WO2011/086660

PCT Pub. Date: Jul. 21, 2011

(65) Prior Publication Data

US 2012/0266843 A1 Oct. 25, 2012

(51) Int. Cl.
*F02M 33/02* (2006.01)

(52) U.S. Cl.
USPC ..... 123/518; 123/1 A; 123/575

(58) Field of Classification Search
USPC ..... 123/516, 518–520, 575, 576–578, 1 A, 123/179.16; 701/103, 112, 113
See application file for complete search history.

(56) References Cited

U.S. PATENT DOCUMENTS

| | | | | | |
|---|---|---|---|---|---|
| 4,423,280 | A * | 12/1983 | Dessau | 585/829 |
| 4,517,402 | A * | 5/1985 | Dessau | 585/820 |
| 5,051,244 | A * | 9/1991 | Dunne et al. | 423/212 |
| 5,271,914 | A * | 12/1993 | Sugimoto et al. | 95/141 |
| 8,105,426 | B2 * | 1/2012 | Kosugi et al. | 96/153 |
| 8,312,867 | B2 * | 11/2012 | Pursifull et al. | 123/516 |
| 8,459,238 | B2 * | 6/2013 | Pursifull et al. | 123/516 |
| 2008/0092851 | A1 | 4/2008 | Arakawa et al. | |
| 2009/0159057 | A1 | 6/2009 | Pursifull et al. | |

FOREIGN PATENT DOCUMENTS

| | | |
|---|---|---|
| JP | A-2006-257907 | 9/2006 |
| JP | A-2008-088941 | 4/2008 |
| JP | A-2008-106623 | 5/2008 |
| JP | A-2008-248840 | 10/2008 |
| JP | A-2009-036151 | 2/2009 |
| JP | A-2009-150397 | 7/2009 |
| JP | A-2009-257309 | 11/2009 |
| JP | A-2009-281330 | 12/2009 |

OTHER PUBLICATIONS

Apr. 27, 2010 International Search Report issued in International Patent Application No. PCT/JP2010/050226.

* cited by examiner

*Primary Examiner* — Thomas Moulis
(74) *Attorney, Agent, or Firm* — Oliff & Berridge, PLC

(57) ABSTRACT

A fuel injection apparatus for an internal combustion engine including a fuel injector having a leading end portion that has an internal space in which fuel is stored and an injection nozzle for injecting fuel; and an adsorbent disposed in the internal space, the adsorbent being capable of selectively adsorbing an alcohol component in a blended fuel of gasoline and alcohol. The adsorbent has a characteristic such that an amount of alcohol adsorption is small when a fuel pressure is low and large when the fuel pressure is high. Adsorption of alcohol onto, and desorption of alcohol from, the adsorbent can be controlled by changing the fuel pressure in the internal space.

13 Claims, 7 Drawing Sheets

FUEL INJECTION APPARATUS FOR INTERNAL COMBUSTION ENGINE

TECHNICAL FIELD

The present invention relates to a fuel injection apparatus for an internal combustion engine.

BACKGROUND ART

A known internal combustion engine can use a blended fuel that is a mixture of gasoline and alcohol such as ethanol or methanol. FIG. 10 is a chart showing a relationship between a distillation rate and a temperature of E80 (a blended fuel with 80% ethanol), E20 (a blended fuel with 20% ethanol), and E0 (100% gasoline). Gasoline is composed of multiple components including one having a low boiling point which contributes to an outstanding vaporization characteristic even at low temperatures. Alcohol, on the other hand, is composed of a single component and thus has a fixed boiling point which is high (about 78° C. for ethanol). As is known from FIG. 10, therefore, a blended fuel having a high concentration of alcohol, such as E80, has a drawback that the fuel is extremely difficult to vaporize at temperatures lower than the boiling point of alcohol. Note that a blended fuel having a relatively low alcohol concentration, such as E20, may actually more readily vaporize than 100% gasoline because of azeotropic phenomenon.

For the reasons as described above, when a blended fuel having a high alcohol concentration is used, substantially only the gasoline component vaporizes of the blended fuel injected from a fuel injector during cold starting of the internal combustion engine, with very little of the alcohol component vaporizing. This results in an insufficient amount of vaporized fuel that contributes to combustion, thus posing a problem of tendency toward poor startability. In addition, the starting relies only on the gasoline component of the blended fuel injected, so that a large amount of fuel needs to be injected at starting in order to compensate for the insufficiency. An amount of alcohol component many times the amount of gasoline component that has contributed to combustion fails to vaporize and burn, flowing past a combustion chamber into an exhaust path in a form of HC. This results in a problem in that the amount of HC discharged into the atmosphere tends to be extremely large during cold starting.

JP-A-2009-150397 discloses a fuel apparatus that incorporates a fuel separation membrane for separating a blended fuel into a gasoline component and an alcohol component, and two fuel injectors for each cylinder, a first fuel injector for injecting the gasoline component and a second fuel injector for injecting the alcohol component. In this apparatus, the fuel separation membrane is disposed inside a first fuel rail assembly that communicates with the first fuel injector of each cylinder. The alcohol component separated by the fuel separation membrane element is sent to a second fuel rail assembly that communicates with the second fuel injector of each cylinder. The apparatus is thus capable of injecting only the gasoline component during starting, so that the above problem can be solved.

PRIOR ART DOCUMENTS

Patent Document

Patent Document 1: JP-A-2009-150397
Patent Document 2: JP-A-2008-248840
Patent Document 3: JP-A-2006-257907

SUMMARY OF THE INVENTION

Problems to be Solved by the Invention

The above-described conventional technique, however, requires two separate fuel supply systems for gasoline injection and alcohol injection, each including a fuel injector, a fuel rail assembly (delivery pipe), and a fuel path, etc. This nearly doubles the cost, weight, and space requirement of the fuel supply system, leading to a significant cost increase, aggravated fuel economy due to the weight increase, and aggravated mountability.

JP-A-2006-257907 discloses an apparatus that supplies, during cold starting of the engine, water to a delivery pipe to separate a blended fuel into a gasoline component and an alcohol component and then supplies the separated gasoline component to a fuel injector. This apparatus requires only one fuel supply system. However, the passage from the delivery pipe to the fuel injector and the inside of the fuel injector have a volume of at least about 1 cc. The blended fuel that existed in the volume before starting will thus be directly injected during starting. That is, in this apparatus, the blended fuel having a high alcohol concentration is directly injected during the first several cycles of starting, so the problems of startability and HC emission into the atmosphere cannot be sufficiently improved.

The present invention has been made to solve the foregoing problems and it is an object of the present invention to provide a fuel injection apparatus for an internal combustion engine using a blended fuel of gasoline and alcohol, the apparatus being capable of immediately reducing an alcohol concentration of fuel to be injected from a fuel injector of the internal combustion engine whenever necessary.

Means for Solving the Problem

First aspect of the present invention is a fuel injection apparatus for an internal combustion engine, comprising:

a fuel injector having a leading end portion that has an internal space in which fuel is pooled and an injection nozzle for injecting fuel; and an adsorbent disposed in the internal space, the adsorbent being capable of selectively adsorbing an alcohol component in a blended fuel of gasoline and alcohol.

Second aspect of the present invention is the fuel injection apparatus for an internal combustion engine according to the first aspect, wherein:

the adsorbent has a characteristic such that an amount of alcohol adsorption is small when a fuel pressure is low and large when the fuel pressure is high.

Third aspect of the present invention is the fuel injection apparatus for an internal combustion engine according to the first or the second aspect, further comprising:

means for controlling adsorption of alcohol onto, and desorption of alcohol from, the adsorbent by changing a fuel pressure in the internal space.

Fourth aspect of the present invention is the fuel injection apparatus for an internal combustion engine according to any one of the first to the third aspects, further comprising:

means for determining whether or not there is a requirement for lowering an alcohol concentration of a fuel to be injected from the fuel injector than an alcohol concentration of a fuel supplied to the fuel injector; and means for letting the adsorbent adsorb alcohol when it is determined that there is the requirement.

Fifth aspect of the present invention is the fuel injection apparatus for an internal combustion engine according to any one of the first to the fourth aspects, further comprising:

means for, upon cold starting of the internal combustion engine, making an alcohol concentration of a fuel to be injected from the fuel injector lower than an alcohol concentration of a fuel supplied to the fuel injector by adsorbing alcohol on the adsorbent.

Sixth aspect of the present invention is the fuel injection apparatus for an internal combustion engine according to any one of the first to the fifth aspects, further comprising:

determining means for determining, based on a condition of the internal combustion engine, whether an permission condition for permitting desorption of alcohol from the adsorbent holds; and desorption control means for maintaining a condition in which alcohol is adsorbed on the adsorbent when it is determined that the permission condition does not hold, and desorbing alcohol from the adsorbent when it is determined that the permission condition holds.

Seventh aspect of the present invention is the fuel injection apparatus for an internal combustion engine according to the sixth aspect, further comprising:

fuel cut means for performing fuel cut of the internal combustion engine when a predetermined fuel cut condition holds, wherein:

the permission condition includes that the fuel cut is being performed.

Eighth aspect of the present invention is the fuel injection apparatus for an internal combustion engine according to the sixth aspect, wherein:

the permission condition includes that an engine speed and an engine load fall within a predetermined range.

Ninth aspect of the present invention is the fuel injection apparatus for an internal combustion engine according to the eighth aspect, wherein:

the predetermined range is a range on a low speed side and a high load side.

Tenth aspect of the present invention is the fuel injection apparatus for an internal combustion engine according to any one of the first to the ninth aspects, wherein:

the adsorbent has a smaller alcohol adsorption capacity at a position closer to the injection nozzle compared to that of a position farther from the injection nozzle.

Eleventh aspect of the present invention is the fuel injection apparatus for an internal combustion engine according to the tenth aspect, wherein:

the adsorbent is small in quantity at a position closer to the injection nozzle compared to that at a position farther from the injection nozzle.

Twelfth aspect of the present invention is the fuel injection apparatus for an internal combustion engine according to the tenth aspect, wherein:

a portion of the adsorbent closer to the injection nozzle is formed from a material having a low alcohol adsorption ability compared to that of a material used for a portion of the adsorbent farther from the injection nozzle.

Thirteenth aspect of the present invention is the fuel injection apparatus for an internal combustion engine according to any one of the first to the twelfth aspects, wherein:

the adsorbent is disposed cylindrically along an inner periphery of the leading end portion of the fuel injector.

Effects of the Invention

In the first aspect of the present invention, the alcohol concentration of the alcohol blended fuel can be reduced in an inside of the leading end portion of the fuel injector. The alcohol concentration of the fuel to be injected can therefore be reduced immediately whenever necessary (e.g. during cold starting). Since the first aspect of the present invention allows the foregoing effect to be achieved without having a fuel injector for use exclusively for alcohol, the fuel supply system can be simplified for reduction in cost and weight.

According to the second aspect of the present invention, alcohol can be adsorbed on the adsorbent by increasing the fuel pressure and desorbed from the adsorbent by decreasing the fuel pressure.

According to the third aspect of the present invention, adsorption of the alcohol onto the adsorbent and desorption of the alcohol from the adsorbent can be quickly and reliably controlled by changing the fuel pressure.

According to the fourth aspect of the present invention, if there is a requirement for lowering the alcohol concentration of the fuel to be injected from the fuel injector, fuel having a lowered alcohol concentration can be injected immediately in response to the requirement.

According to the fifth aspect of the present invention, the alcohol concentration of the fuel to be injected from the fuel injector can be lowered during cold starting of the internal combustion engine. As a result, the amount of HC emissions discharged into the atmosphere can be reduced and startability can be improved.

According to the sixth aspect of the present invention, when the internal combustion engine is in a condition in which the alcohol adsorbed on the adsorbent should not be desorbed, desorption of the alcohol can be prevented, and the alcohol can be desorbed after waiting for the internal combustion engine to reach a condition in which the alcohol should be desorbed. That is, the alcohol can be desorbed by selecting an appropriate engine condition in which adverse effects are unlikely to arise from alcohol desorption. The adverse effects from alcohol desorption can therefore be reliably avoided from occurring.

According to the seventh aspect of the present invention, alcohol can be desorbed during performance of fuel cut. Occurrence of control error of air-fuel ratio due to alcohol desorption can thereby be reliably suppressed.

According to the eighth aspect of the present invention, alcohol can be desorbed when the engine speed and the engine load fall within the predetermined range. The adverse effects from alcohol desorption can therefore be reliably avoided from occurring.

According to the ninth aspect of the present invention, when the engine speed and the engine load fall within the range on a low speed side and high load side, alcohol can be desorbed while performing fuel cut. This reliably suppresses occurrence of control errors of the air-fuel ratio arising from alcohol desorption.

According to the tenth aspect of the present invention, desorption of alcohol can be suppressed when fuel pressure at a portion near the injection nozzle decreases during fuel injection. The alcohol concentration of injected fuel can therefore be reliably reduced when necessary.

According to the eleventh aspect of the present invention, desorption of alcohol can be suppressed when fuel pressure at a portion near the injection nozzle decreases during fuel injection. The alcohol concentration of injected fuel can therefore be reliably reduced when necessary.

According to the twelfth aspect of the present invention, desorption of alcohol can be suppressed when fuel pressure at a portion near the injection nozzle decreases during fuel injection. The alcohol concentration of injected fuel can therefore be reliably reduced when necessary.

According to the thirteenth aspect of the present invention, an adsorbent having a sufficient capacity can be disposed in a small internal space in the leading end portion of the fuel injector.

MODE FOR CARRYING OUT THE INVENTION

Figure 1:
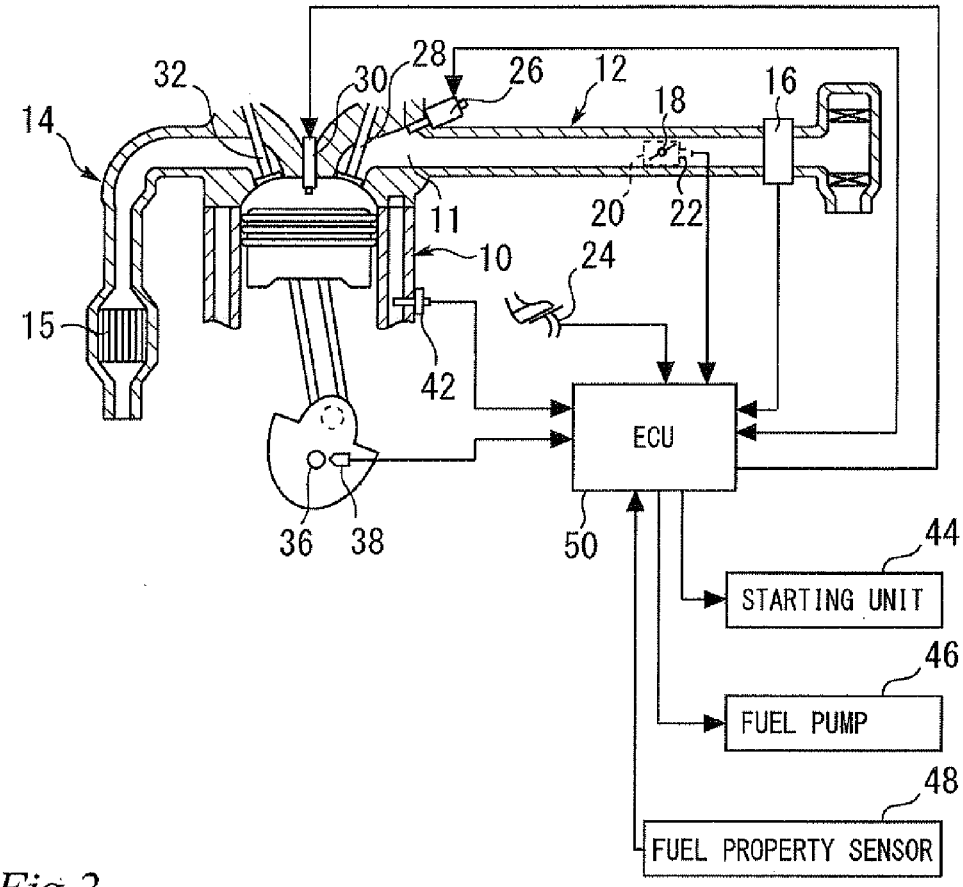
FIG. 1 shows the configuration of a system according to a first embodiment of the present invention.

Embodiments of the present invention will be described below with reference to the accompanying drawings. In each of the drawings, like or equal elements are identified by the same reference numerals and descriptions therefor will not to be duplicated.

First Embodiment

FIG. 1 is a diagram for illustrating a system configuration of a first embodiment of the present invention. Referring to FIG. 1, the system according to this embodiment includes an internal combustion engine 10. The internal combustion engine 10 is used, for example, as a driving power source for a vehicle. The internal combustion engine 10 of this embodiment is an in-line four-cylinder type; however, the number and arrangement of cylinders of the internal combustion engine according to the present invention are not specifically limited. FIG. 1 is a cross-sectional view of a single cylinder of the internal combustion engine 10.

The internal combustion engine 10 is operable on not only gasoline, but also a fuel that is a mixture composed of gasoline and ethanol, methanol, or other type of alcohol (hereinafter referred to also as an "alcohol-blended fuel" or a "blended fuel"). In this case, the alcohol-blended fuel may range from one having a low concentration (e.g. about several percent) of an alcohol component (ratio of the alcohol component) to one having a high concentration (e.g. 80% or more).

The internal combustion engine 10 is connected with an intake path 12 and an exhaust path 14. An air flow meter 16 for detecting an intake air amount is disposed on the intake path 12. A throttle valve 18 is disposed downstream of the air flow meter 16. The throttle valve 18 has an opening adjusted by operation of a throttle motor 20. A throttle position sensor 22 for detecting the opening of the throttle valve 18 is disposed near the throttle valve 18. A catalyst 15 for purifying an exhaust gas is disposed on the exhaust path 14.

A fuel injector 26 for injecting fuel into an intake port 11 is disposed at each cylinder of the internal combustion engine 10. In addition, an intake valve 28, an ignition plug 30, and an exhaust valve 32 are disposed on each cylinder of the internal combustion engine 10.

A crank angle sensor 38 capable of detecting a rotational angle of a crankshaft 36 (crank angle) is disposed near the crankshaft 36 of the internal combustion engine 10. The crank angle sensor 38 can detect the crank angle and a speed of the internal combustion engine 10.

The system of this embodiment generally includes an accelerator position sensor 24, a coolant temperature sensor 42, a starting unit 44, a fuel pump 46, a fuel property sensor 48, and an ECU (electronic control unit) 50. Specifically, the accelerator position sensor 24 detects an amount of depression of an accelerator pedal on a driver's seat side of the vehicle on which the internal combustion engine 10 is mounted. The coolant temperature sensor 42 detects a coolant temperature of the internal combustion engine 10. The starting unit 44 includes a motor for rotatably driving the crankshaft 36 at starting of the internal combustion engine 10. Sensors and actuators of various types including the above are electrically connected to the ECU 50.

Figure 2:
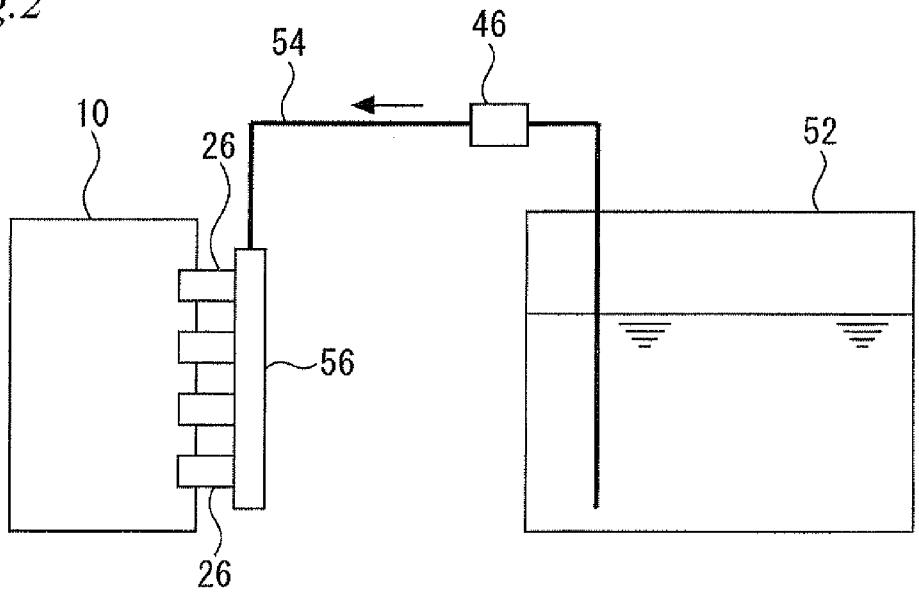
FIG. 2 is an illustration showing schematically a fuel system that supplies an internal combustion engine with fuel.

FIG. 2 is an illustration showing schematically a fuel system that supplies the internal combustion engine 10 with fuel. Referring to FIG. 2, the system of this embodiment includes a fuel tank 52. The fuel tank 52 is connected to a delivery pipe 56 via a fuel supply path 54. The fuel pump 46 that pressurizes fuel is disposed midway in the fuel supply path 54. This is, however, not the only possible location at which to dispose the fuel pump 46; rather, the fuel pump 46 may be disposed, for example, inside the fuel tank 52. Fuel accumulated in the fuel tank 52 is pressurized by the fuel pump 46 and sent to the delivery pipe 56 through the fuel supply path 54. The delivery pipe 56 distributes fuel to the fuel injector 26 of each cylinder. The fuel pump 46 is adapted to be able to send fuel to the delivery pipe 56 by regulating a fuel pressure to a value commanded by the ECU 50. Specifically, in the system of this embodiment, the fuel pressure inside the fuel injector 26 (specifically, a fuel injection pressure) is adjustable with the fuel pump 46.

Concentration of alcohol in fuel to be supplied to the fuel injector 26, specifically, fuel accumulated in the fuel tank 52 (hereinafter referred to as "in-tank fuel") increases or decreases according to the alcohol concentration of fuel selected for refueling by a user. In this embodiment, the alcohol concentration of the in-tank fuel can be detected by the fuel property sensor 48 disposed midway in the fuel supply path 54. For the fuel property sensor 48, a type of sensor may be used that detects the alcohol concentration by, for example, measuring dielectric constant or refractive index of the fuel. The position at which the fuel property sensor 48 is disposed in the figure is not the only possible arrangement. For example, the fuel property sensor 48 may be disposed in the fuel tank 52 or on the delivery pipe 56. Further, in the present invention, the method for detecting the alcohol concentration of the in-tank fuel is not limited to one using the fuel property sensor 48. For example, the alcohol concentration of the fuel may be detected (estimated) from a learned value in an air-fuel ratio feedback control. Specifically, the gasoline and the alcohol have different stoichiometric air-fuel ratio values, so that the stoichiometric air-fuel ratio value of the alcohol-blended fuel varies depending on the alcohol concentration. This allows the alcohol concentration of the in-tank fuel to be detected (estimated) based on the stoichiometric air-fuel ratio value learned using a signal fed back from an air-fuel ratio sensor (not shown) disposed in the exhaust path 14.

Figure 3:
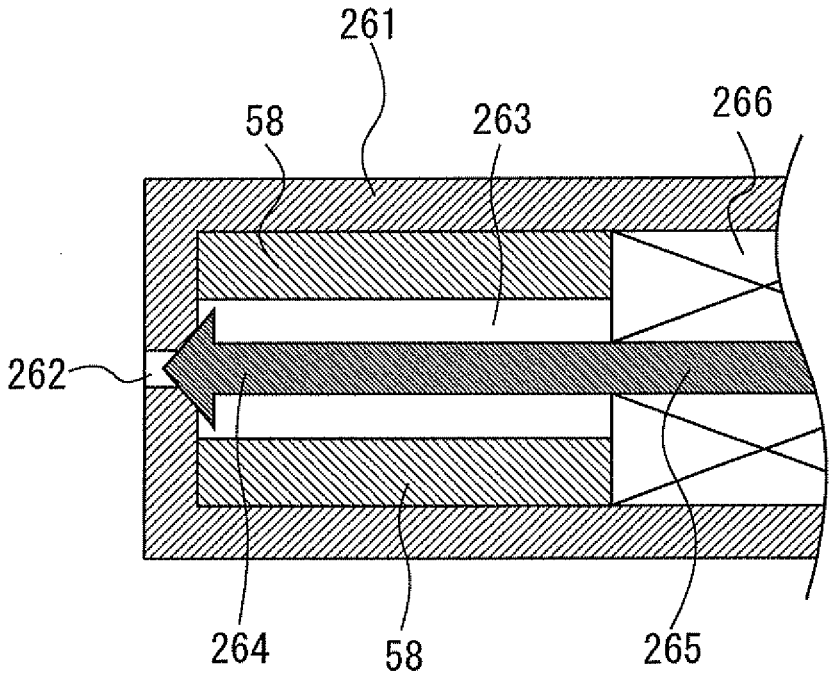
FIG. 3 is an enlarged cross-sectional view showing a leading end portion of a fuel injector.

FIG. 3 is an enlarged cross-sectional view showing a leading end portion of the fuel injector 26 included in the internal combustion engine 10 of this embodiment. Referring to FIG. 3, the fuel injector 26 has a leading end portion 261. The leading end portion 261 includes an injection nozzle 262 for injecting fuel and an internal space 263 in which fuel is pooled (filled with fuel). A needle valve 264 as an injection valve is passed through the internal space 263. The needle valve 264 opens and closes the injection nozzle 262. A plunger 265 is integrally formed on a proximal end side of the needle valve 264. A solenoid coil 266 is disposed around the plunger 265. When the solenoid coil 266 is energized, the plunger 265 is pulled in the solenoid coil 266, so that the plunger 265 and the needle valve 264 move to the proximal end side, which opens the injection nozzle 262. This allows fuel in the internal space 263 to be injected from the injection nozzle 262. When the solenoid coil 266 is de-energized, the plunger 265 and the needle valve 264 are brought back to their original positions by an urging force of a spring not shown. This closes the injection nozzle 262 to stop injection. Such a fuel pressure in the internal space 263 of the fuel injector 26 (hereinafter referred to also simply as the "fuel pressure") can be controlled to vary from low to high by a command issued from the ECU 50 to the fuel pump 56 as described earlier.

An adsorbent 58 is disposed in the internal space 263 at the leading end portion 261 of the fuel injector 26. According to the arrangement shown in the figure, the adsorbent 58 is disposed in a tubular form along an inner periphery of the internal space 263. Specifically, the adsorbent 58 is disposed so as to surround an outer peripheral side of the needle valve 264. A type having a property of selectively adsorbing the alcohol component in the alcohol-blended fuel is selected as the adsorbent 58. As a constituent material of such an adsorbent 58, a highly hydrophilic, porous body having fine pores on a molecule level that can take in alcohol molecules may be used; typically, zeolite is preferably used. Particularly preferably, a type of zeolite having a strong polarity is used. Use of the zeolite having the strong polarity allows alcohol molecules having a strong polarity to be reliably and selectively adsorbed from the fuel containing the gasoline component. Note also that, for example, pore size varies depending on a skeletal structure of the porous body used for the adsorbent 58 (for example, type A, type Y, and type X for zeolite). By selecting an optimum skeletal structure according to the size of the alcohol molecule in question, therefore, a favorable alcohol adsorption property can be obtained. To adsorb ethanol, for example, type A zeolite can be particularly preferably used.

The adsorbent 58 has a property that the amount of alcohol adsorbed onto the adsorbent 58 (hereinafter referred to as an "adsorbed amount of alcohol") is small when an ambient fuel pressure is low and the adsorbed amount of alcohol is large when the fuel pressure is high. The embodiment utilizes this property to control the adsorbed amount of alcohol on the adsorbent 58, thereby allowing the alcohol concentration of the fuel injected from the fuel injector 26 to be lower than that of the fuel supplied thereto (specifically, the in-tank fuel). Specifically, when the fuel pressure is increased from a low pressure state in which the adsorbed amount of alcohol is small to a high pressure state in which the adsorbed amount of alcohol is large, the alcohol component of the blended fuel resident in the internal space 263 is selectively adsorbed onto the adsorbent 58. This results in a decreased alcohol concentration of the blended fuel resident in the internal space 263, and an increased gasoline concentration thereof. By increasing the fuel pressure and injecting fuel from the fuel injector 26, therefore, the alcohol concentration of the fuel injected from the fuel injector 26 can be made lower than the alcohol concentration of the in-tank fuel.

The embodiment uses the foregoing function to control such that, during cold starting of the internal combustion engine 10, the alcohol concentration of the fuel to be injected from the fuel injector 26 is lower than that of the in-tank fuel. This allows fuel with a lower alcohol concentration and a higher gasoline concentration than the in-tank fuel (hereinafter referred to as an "alcohol concentration reduced fuel") to be injected from the fuel injector 26 during the cold starting, even if the alcohol concentration of the in-tank fuel is high. Good startability can therefore be obtained and a amount of RC emissions into the atmosphere can be reduced substantially.

In this apparatus, in particular, the alcohol concentration reduced fuel can be generated in the internal space 263 disposed immediately before the injection nozzle 262, which allows the alcohol concentration reduced fuel to be injected in the first injection sequence onward during starting. By contrast, in an arrangement in which the alcohol concentration reduced fuel is generated at a position before the fuel injector 26 (for example, the delivery pipe 56), the alcohol concentration reduced fuel can be injected only after the fuel injection sequence is repeatedly performed at least to replace the fuel in the fuel injector 26 with the alcohol concentration reduced fuel.

Being able to inject the alcohol concentration reduced fuel in the first injection sequence onward during starting is extremely effective in reducing the amount of HC emissions into the atmosphere for the following reasons. In the beginnings of cold starting, the catalyst 15 is yet to be warmed by the exhaust gas and remains inactive. As a result, most of HC discharged from the internal combustion engine 10 is discharged as it is into the atmosphere without being purified by the catalyst 15. When combustion thereafter starts in the internal combustion engine 10, the exhaust gas starts flowing into the catalyst 15 to thereby warm the catalyst 15, so that the catalyst 15 starts exhibiting catalytic activity, resulting in HC being purified by the catalyst 15. To reduce the amount of HC emissions into the atmosphere during cold starting, therefore, it is extremely important to reduce the amount of HC discharged from the internal combustion engine 10 for the first several cycles during which the catalyst 15 is yet to be warmed. In this respect, this apparatus can inject the alcohol concentration reduced fuel in the first injection sequence onward during starting, so that the amount of alcohol component flowing to the exhaust path 14 without being burned can be reliably reduced. Thus, the amount of HC emissions into the atmosphere during cold starting can be extremely effectively reduced.

When the adsorbed amount of alcohol on the adsorbent 58 is saturated, the adsorbent 58 can no longer adsorb alcohol. As a result, the alcohol concentration of fuel to be injected is brought back to the original level, specifically, the alcohol concentration of the in-tank fuel, through the process of repeated fuel injection sequences from the fuel injector 26 after the internal combustion engine 10 has been started. However, the catalyst 15 is warmed enough during the process to exhibit the activity, which starts purification of HC with the catalyst 15. Discharge of HC into the atmosphere can therefore be sufficiently inhibited. Meanwhile, the internal combustion engine 10 is also warmed during a period through which the alcohol concentration of fuel to be injected from the fuel injector 26 returns to the original level, which promotes vaporization of the alcohol component. Aggravation of driving stability of the internal combustion engine 10 after starting can therefore be sufficiently inhibited.

Figure 4:
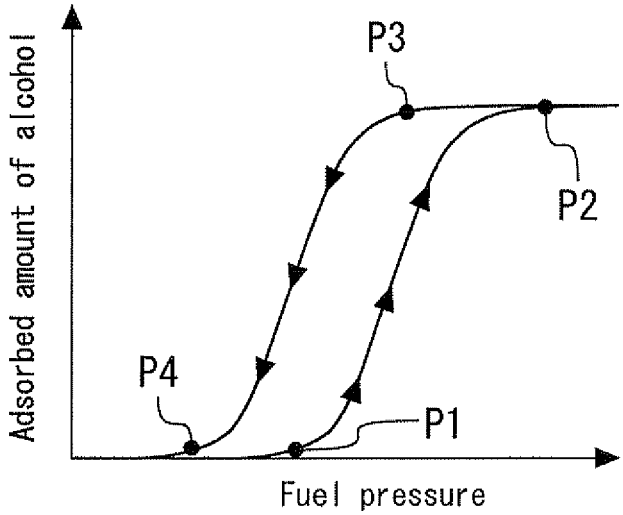
FIG. 4 is a graph showing a relationship between a fuel pressure and an adsorbed amount of alcohol on an adsorbent.

FIG. 4 is a graph showing a relationship between the fuel pressure and the adsorbed amount of alcohol on the adsorbent 58. As described earlier, the adsorbed amount of alcohol is small when the fuel pressure is low and large when the fuel pressure is high. Additionally, the adsorbed amount of alcohol has a hysteresis relative to a history of the fuel pressure as indicated by arrows affixed to curves in FIG. 4. Specifically, the curve on the right in FIG. 4 represents changes in the adsorbed amount of alcohol in a process of the adsorbent 58 adsorbing the alcohol when the fuel pressure is increased from a low pressure to a high pressure. The curve on the left in FIG. 4 represents changes in the adsorbed amount of alcohol in a process of the adsorbent 58 desorbing the adsorbed alcohol when the fuel pressure is decreased from a high pressure to a low pressure.

The ECU 50 can control adsorption of alcohol onto, or desorption of alcohol from, the adsorbent 58 by changing over a value of a set pressure of the fuel pump 46 between a low pressure and a high pressure to thereby vary the fuel pressure in the internal space 263 of the fuel injector 26. The adsorbed amount of alcohol onto the adsorbent 58 is saturated when the fuel pressure rises up to P2 in FIG. 4. Consequently, the fuel pressure is preferably set to more than P2 when the alcohol is to be adsorbed onto the adsorbent 58. This allows an alcohol adsorption ability of the adsorbent 58 to be fully extracted. Note, however, that alcohol can be adsorbed onto the adsorbent 58 with a fuel pressure of P1 or more in FIG. 4. To let alcohol be adsorbed onto the adsorbent 58, therefore, the fuel pressure has only to be increased to a value higher than at least P1.

When the fuel pressure is decreased from a condition in which the adsorbed amount of alcohol onto the adsorbent 58 is saturated, substantially no amount of alcohol is desorbed from the adsorbent 58 with a fuel pressure of up to P3 in FIG. 4. When the fuel pressure is lower than P3, desorption of alcohol from the adsorbent 58 is quickly started and, when the pressure is decreased to P4 in FIG. 4, the adsorbed amount of alcohol is substantially zero. To desorb alcohol from the adsorbent 58, therefore, the fuel pressure is preferably set to a value of P4 or lower. This allows a substantially whole amount of alcohol adsorbed onto the adsorbent 58 to be desorbed therefrom. Note, however, that the desorption of alcohol starts with a fuel pressure of P3 in FIG. 4 as described above. To let alcohol be desorbed from the adsorbent 58, therefore, the fuel pressure has only to be decreased down to a value less than at least P3.

Figure 5:
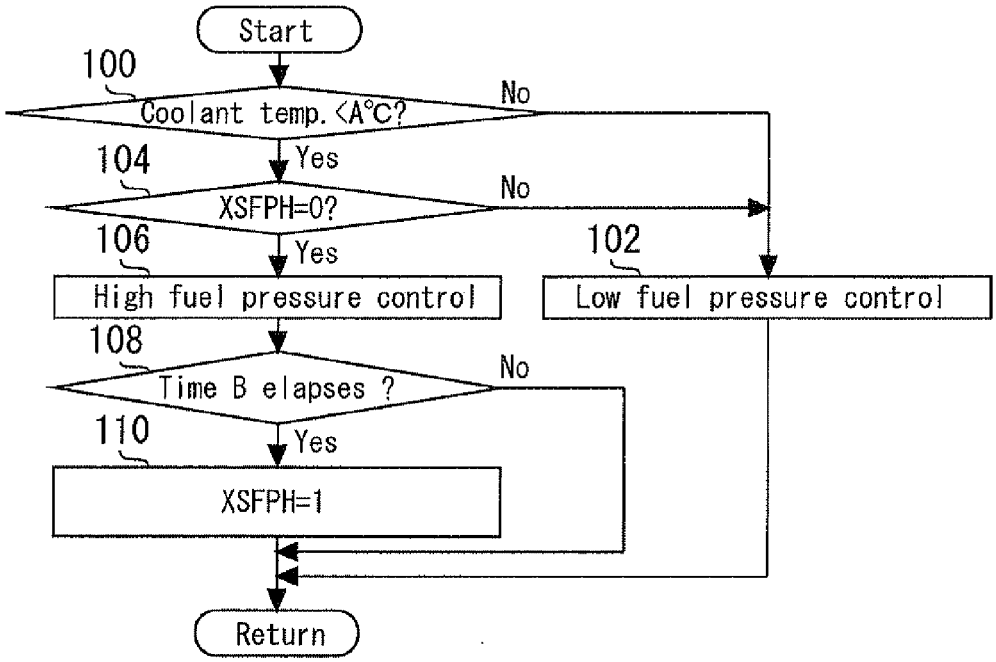
FIG. 5 is a flowchart illustrating a routine that is executed by the first embodiment of the present invention.

FIG. 5 is a flow chart showing a routine performed by the ECU 50 in this embodiment in order to achieve the above-described function. The routine is repeatedly performed every predetermined time at start-up of the internal combustion engine 10.

According to the routine shown in FIG. 5, first, a coolant temperature of the internal combustion engine 10 during starting, which is detected by the coolant temperature sensor 42, is compared with a predetermined temperature A° C. (step 100). In this embodiment, the starting is determined to be a cold starting when the coolant temperature during starting is lower than the predetermined temperature A° C., and determined to be a warm starting when the coolant temperature during starting is equal to or higher than the predetermined temperature A° C. For a cold starting, in order to reduce alcohol concentration of a fuel to be injected from the fuel injector 26 (hereinafter referred to as "injected fuel"), the starting is performed with the fuel pressure set to a high level such that the alcohol will be adsorbed onto the adsorbent 58 (hereinafter referred to as a "high fuel pressure").

On the other hand, for a warm starting, it can be determined that startability will not be aggravated and HC will not be discharged into the atmosphere even if the alcohol concentration of the injected fuel is not lowered. Warm starting is therefore performed with the fuel pressure set to a low level such that the alcohol will not be adsorbed onto the adsorbent 58 (hereinafter referred to as a "low fuel pressure"). That is, when it is determined in step 100 that the coolant temperature during starting is equal to or higher than the predetermined temperature A° C., a low fuel pressure control that sets the pressure of the fuel pump 46 to the low fuel pressure is carried out (step 102). As such, in a warm starting, fuel injection at a low fuel pressure is performed from the beginning.

Power consumption of the fuel pump 46 increases with increase of fuel pressure. According to the above-described control, injection pressure is set to a low fuel pressure in warm starting which does not require the alcohol concentration of the injected fuel to be reduced. The power consumption of the fuel pump 46 can therefore be saved.

When it is determined in step 100 that the coolant temperature during starting is lower than the predetermined temperature A° C., i.e., when the starting is a cold starting, whether a starting high fuel pressure completion flag XSFPH is 0 is next judged (step 104). The default value of the starting high fuel pressure completion flag XSFPH is 0. The determination made in step 104 is therefore in the affirmative at first. When the determination in step 104 is in the affirmative, a high fuel pressure control that sets the pressure of the fuel pump 46 to a high fuel pressure is carried out (step 106). As a result, alcohol can be adsorbed onto the adsorbent 58 and the alcohol concentration of the injected fuel can be made lower than that of the in-tank fuel. This allows good startability to be achieved and reliably reduces the amount of HC emissions into the atmosphere.

Incidentally, the amount of adsorbed alcohol on the adsorbent 58 of when the high fuel pressure control of step 106 is performed can be calculated based on the fuel pressure by storing a map as shown in FIG. 4 in the ECU 50 in advance. When the high fuel pressure control is performed, the alcohol concentration of the fuel in the internal space 263 after adsorbing alcohol (i.e., the alcohol concentration of the injected fuel) can be calculated based on the amount of adsorbed alcohol, the alcohol concentration of the original fuel (i.e., the alcohol concentration of the in-tank fuel), and the effective volume of the internal space 263.

When the high fuel pressure control of step 106 is performed, for the following reason, the fuel injection amount is preferably corrected based on the alcohol concentration of the injected fuel. Alcohol has a stoichiometric air-fuel ratio lower than that of gasoline. The stoichiometric air-fuel ratio of the blended fuel is therefore lower as the alcohol concentration is higher. To obtain a mixture at the stoichiometric air-fuel ratio, therefore, a correction for increasing the fuel injection amount (volume) is needed as higher the alcohol concentrations of the fuel is. This correction is generally made based on the alcohol concentration of the in-tank fuel. When the high fuel pressure control of step 106 is performed, correction can be made based on the alcohol concentration of the injected fuel calculated as above.

When the engine temperature is low (e.g., 25° C. or lower), substantially no vaporization can be expected for the alcohol component of the blended fuel. This requires a mixture at a desired air-fuel ratio to be generated with substantially only the gasoline component of the blended fuel. Thus, when the temperature is low, a correction for increasing the fuel injection amount is made as higher the alcohol concentration of the fuel is. This correction is generally made based on the alcohol concentration of the in-tank fuel. When the high fuel pressure control of step 106 is performed, correction can be made based on the alcohol concentration of the injected fuel calculated as above.

When the high fuel pressure control of step 106 is performed, it is then determined whether the elapsed time after starting has reached a predetermined period of time B (step 108). The predetermined period of time B is set in advance so that, even when warm-up of the internal combustion engine 10 or the catalyst 15 progresses to a certain degree to desorb the alcohol from the adsorbent 58, there will be no adverse effect on operation of the internal combustion engine 10 and the amount of HC emissions into the atmosphere. When it is determined in step 108 that the elapsed time after starting has reached the predetermined period of time B, the starting high fuel pressure completion flag XSFPH is set to 1 (step 110). When the starting high fuel pressure completion flag XSFPH is set to 1, the determination in step 104 will be in the negative in the next performance of the routine, so that operation shifts to the low fuel pressure control of step 102.

As described above, when the high fuel pressure control is performed during a cold starting, the high fuel pressure control is terminated at the time the elapsed time after starting reaches the predetermined period of time B, and then switches to the low fuel pressure control. This results in the fuel pressure being reduced, whereby the alcohol adsorbed on the adsorbent 58 desorbs. Addition of the desorbed alcohol increases the alcohol concentration of the fuel in the internal space 263. The alcohol concentration of the injected fuel is therefore temporarily higher than that of the in-tank fuel. After that, the alcohol concentration of the injected fuel returns to a level equivalent to the alcohol concentration of the in-tank fuel. The alcohol adsorption ability of the adsorbent 58 can be recovered by desorbing alcohol from the adsorbent 58. Therefore, upon the next cold starting, alcohol can be adsorbed on the adsorbent 58 likewise.

According to the above-described processes of the routine shown in FIG. 5, when the high fuel pressure control is performed during a cold starting to adsorb alcohol with the adsorbent 58, the alcohol can be quickly desorbed from the adsorbent 58 at a point where warm-up of the internal combustion engine 10 or the catalyst 15 has progressed to some degree. The alcohol adsorbed on the adsorbent 58 can therefore be reliably desorbed before operation of the internal combustion engine 10 is stopped.

Although omitted from the routine in FIG. 5, control as described below may be performed. If the alcohol concentration of the in-tank fuel is originally sufficiently low, adsorption of alcohol onto the adsorbent 58 may not be necessary even for cold starting. Regarding this, a determination may be made during starting by comparing the alcohol concentration of the in-tank fuel with a predetermined threshold value. When the alcohol concentration of the in-tank fuel is higher than the threshold value and the starting is a cold starting, the high fuel pressure control is performed; and when the alcohol concentration of the in-tank fuel is lower than the threshold value, the low fuel pressure control is performed from the beginning whether the starting is a cold or warm starting.

The embodiment has been described that the control is performed, during starting of the internal combustion engine 10, to make the alcohol concentration of the injected fuel lower than the alcohol concentration of the in-tank fuel by letting the adsorbent 58 adsorb the alcohol. In the present invention, however, such a control may be performed as necessary during operation of the internal combustion engine 10.

In the first embodiment described above, cold starting of the internal combustion engine 10 corresponds to the "requirement" in the fourth aspect of the present invention. Performance of the process of step 108 by the ECU 50 achieves the "determining means" in the sixth aspect of the present invention, and performance of the processes of steps 110, 104, 106, and 102 achieves the "desorption control means" in the sixth aspect of the present invention.

Second Embodiment

A second embodiment of the present invention will be described below with reference to FIG. 6. Differences from the first embodiment described above will be mainly described and descriptions of similarities will be simplified or omitted.

In this embodiment, when a predetermined fuel cut condition is satisfied, the ECU 50 performs a fuel cut control which brings fuel injection from the fuel injector 26 to a halt. For example, when the load requirement (torque requirement) of the internal combustion engine 10 is zero and the engine speed is equal to or larger than a predetermined speed, it is determined that deceleration fuel cut conditions are satisfied and deceleration fuel cut will be performed.

As described earlier, in a cold starting in the first embodiment, the high fuel pressure control is first performed to adsorb alcohol with the adsorbent 58, and after the internal combustion engine 10 has warmed up, the high fuel pressure control is switched to the low fuel pressure control to desorb the alcohol from the adsorbent 58.

When the alcohol desorb from the adsorbent 58, the desorbed alcohol is mixed with the fuel in the internal space 263 of the fuel injector 26. This makes the alcohol concentration of the injected fuel be temporarily higher than that of the in-tank fuel. As described earlier, the fuel injection amount required to achieve the stoichiometric ratio of the mixture varies depending on the alcohol concentration. While the alcohol concentration of the injected fuel is temporarily higher than that of the in-tank fuel, therefore, the fuel injection amount needs to be corrected according to the alcohol concentration of the injected fuel. However, it is not always easy to estimate the alcohol concentration of the injected fuel accurately in this case. The reasons for this are as follows.

When the alcohol desorb from the adsorbent 58, the desorption is not completed instantaneously but in reality takes some time to complete the desorption. Thus, when the high fuel pressure control is switched to the low fuel pressure control, the desorption of the alcohol from the adsorbent 58 extends over several combustion cycles. Each time fuel is injected in each of the combustion cycles, a fuel having an increased alcohol concentration because of the desorbed alcohol is injected from the fuel injector 26, and at the same time, a fresh fuel having the same alcohol concentration as the in-tank fuel is supplied. In such a manner, the alcohol concentration of the injected fuel changes per combustion cycle in accordance with a balance between the amount of alcohol desorbed and the fresh fuel newly supplied in each combustion cycle. It is therefore difficult to estimate accurately the alcohol concentration for each combustion cycle. The fuel injection amount cannot be accurately corrected unless the alcohol concentration could be accurately estimated.

The fuel pressure in the internal space 263 of the fuel injector 26 is controlled by the fuel pump 46. However, because of the distance between the internal space 263 and the fuel pump 46, pressure propagation delay occurs. That is, the fuel pressure in the internal space 263 does not start decreasing at the instant the high fuel pressure control is switched to the low fuel pressure control. It is therefore difficult to accurately find the timing at which the alcohol actually starts desorbing from the adsorbent 58 and appropriately determine with which combustion cycle should the correction of the fuel injection amount be started.

From the foregoing reasons, when the alcohol is desorbed from the adsorbent 58, it is difficult to correct the fuel injection amount accurately, which poses a problem that an error tends to occur in controlling of the air-fuel ratio. To avoid this problem, in this embodiment, the high fuel pressure control is switched to the low fuel pressure control to desorb the alcohol from the adsorbent 58 while performing fuel cut. Because no fuel is injected during performance of fuel errors would not occur in the air-fuel ratio controlling. When the high fuel pressure control is switched to the low fuel pressure control during fuel cut, the alcohol adsorbed on the adsorbent 58 can all be desorbed during fuel cut. Since the adsorbed amount of alcohol on the adsorbent 58 is understood as mentioned earlier, the amount of increase in the alcohol concentration in the internal space 263 when all the alcohol has desorbed can be easily calculated. Thus, the alcohol concentration of the injected fuel of when operation returns from fuel cut to resume fuel injection can be estimated accurately. The fuel injection amount can therefore be accurately corrected after returning from fuel cut, which reliably prevents control errors of the air-fuel ratio from occurring.

Figure 6:
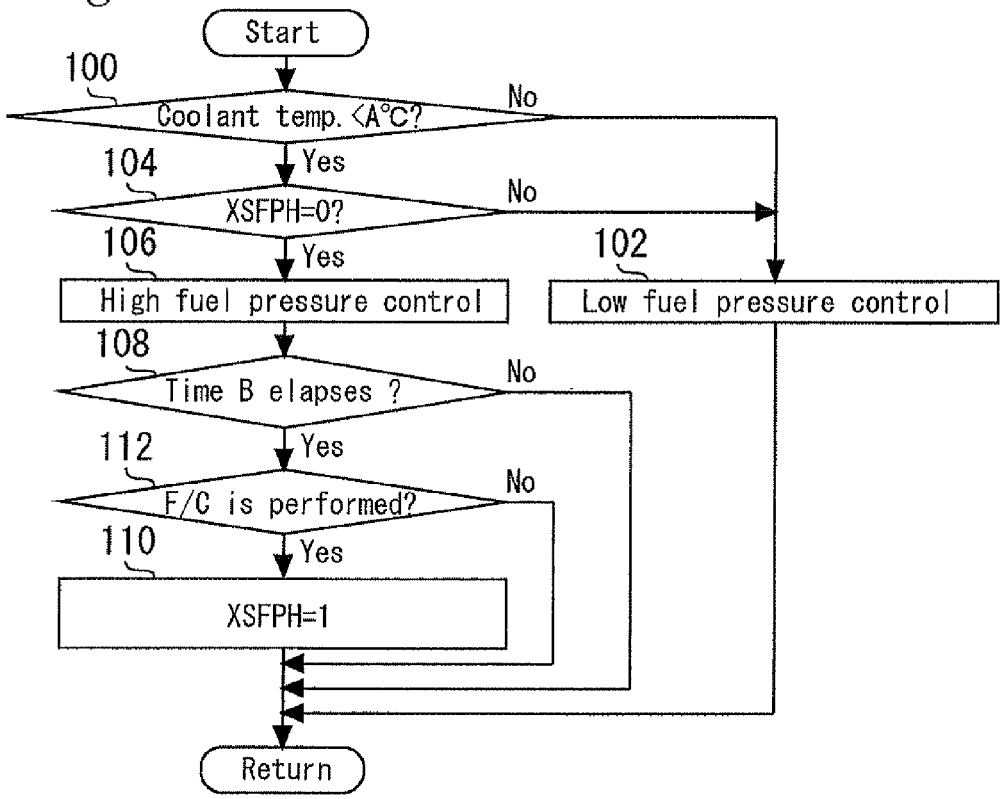
FIG. 6 is a flowchart illustrating a routine that is executed by a second embodiment of the present invention.

FIG. 6 is a flow chart showing a routine performed by the ECU 50 in this embodiment in order to achieve the above-described function. In FIG. 6, the steps same to those of the routine in FIG. 5 are identified by the same reference numerals and descriptions will therefore be omitted or simplified. The routine shown in FIG. 6 is the same as the routine shown in FIG. 5, except that step 112 is inserted between steps 108 and 110.

According to the routine shown in FIG. 6, the high fuel pressure control of step 106 is performed upon a cold starting, and when it is determined in step 108 that the elapsed time after starting has reached the predetermined period of time B, whether the deceleration fuel cut of the internal combustion engine 10 is being performed is next determined (step 112). When it is determined in step 112 that the deceleration fuel cut is not being performed, this routine is terminated without performing the process of step 110 for setting the starting high fuel pressure completion flag XSFPH to 1. When this routine is performed next time, therefore, the determination in step 104 will be in the affirmative so that the high fuel pressure control is continued. That is, the condition in which alcohol is adsorbed on the adsorbent 58 is maintained.

When it is determined in step 112 that deceleration fuel cut is being performed, the process of setting the starting high fuel pressure completion flag XSFPH to 1 is performed (step 110). Thus, the determination in step 104 will be in the negative in the next performance of the routine, and the high fuel pressure control will be terminated and operation shifts to the low fuel pressure control of step 102. This causes alcohol to desorb from the adsorbent 58.

As described above, according to the control of the routine shown in FIG. 6, the alcohol is not immediately desorbed from the adsorbent 58 after the predetermined period of time B has elapsed from the cold starting; instead, after waiting for a deceleration fuel cut to start, the alcohol can be desorbed from the adsorbent 58 during performance of the deceleration fuel cut is. The alcohol is therefore not desorbed from the adsorbent 58 during combustion operation of the internal combustion engine 10, thereby reliably preventing control error of the air-fuel ratio from occurring.

Performance of the processes of steps 108 and 112 by the ECU 50 in the second embodiment described above achieves the "determining means" in the sixth aspect of the present invention, and performance of the processes of steps 110, 104, 106, and 102 achieves the "desorption control means" in the sixth aspect of the present invention.

Third Embodiment

A third embodiment of the present invention will be described below with reference to FIGS. 7 to 9. Differences from the embodiments described above will be mainly described and descriptions of similarities will be simplified or omitted.

As described above, in the second embodiment, the alcohol is desorbed from the adsorbent 58 while performing fuel cut. The control error of the air-fuel ratio caused by desorption of the alcohol is thereby prevented from occurring.

Meanwhile, in this embodiment, the alcohol is desorbed from the adsorbent 58 during combustion operation of the internal combustion engine 10. In addition, the alcohol is desorbed when the engine speed and the engine load fall within predetermined ranges, described later, to thereby suppress occurrence of control errors of air-fuel ratio. FIG. 7 is a diagram showing a range in which desorption of alcohol is permitted in this embodiment with diagonal lines.

The fuel injection amount of the fuel injector 26 is controlled by fuel injection time. The fuel injection amount per unit time increases with higher fuel injection pressures. Fuel injection needs to be performed within a predetermined period of time in a combustion cycle. Therefore, the higher the engine speed is, the shorter the period of time during which fuel injection is capable. In a range in which both the engine speed and the engine load are high (hereinafter referred to as a "high-speed, high-load range"), therefore, a large amount of fuel needs to be injected within a short period of time. This necessitates the fuel injection pressure to be set high in the high-speed, high-load range. In this embodiment, the range higher than the curve kFPH in FIG. 7 corresponds to the high-speed, high-load range where the fuel injection pressure needs to be set high. That is, under normal operating condition, a high pressure is set in the range over the curve kFPH. In contrast, in the range lower than the curve kFPH, the fuel injection can be sufficiently completed within the limit time without setting the pressure to a high pressure. In normal operating condition, therefore, a low pressure is set in the range below the curve kFPH.

As described earlier, when the alcohol is desorbed from the adsorbent 58, the alcohol concentration of the injected fuel becomes temporarily higher than that of the in-tank fuel. To achieve the stoichiometric ratio of the mixture, a greater fuel injection amount is required as higher the alcohol concentrations of the injected fuel is. Therefore, when the alcohol is desorbed from the adsorbent 58, it is necessary to temporarily correct the fuel injection time to increase it.

Assume a case in which the alcohol is to be desorbed from the adsorbent 58 in the high-speed, high-load range. In this case, an increase in the requested injection time associated with a decrease in the fuel injection pressure (from the high fuel pressure to the low fuel pressure) overlaps an increase in the required injection time associated with the increase in the alcohol concentration of the injected fuel. The required injection time requirement is highly likely to fall outside the limit time. Thus, in this embodiment, the alcohol is not desorbed from the adsorbent 58 in the high-speed, high-load range upside the curve kFPH in FIG. 7.

Incidentally, increasing the size of the fuel injector 26 allows the injection amount to be increased relative to one with the same fuel injection pressure and fuel injection time. However, this increases a minimum injection amount so that a minimum injection requirement in a low load range cannot be satisfied. Thus, the solution of increasing the size of the fuel injector 26 is not appropriate.

On the other hand, in order to suppress the control errors of the air-fuel ratio caused by desorption of the alcohol, desorbing the alcohol in the high load range is more advantageous for the following reason. In the high load range, even when the same amount of alcohol is desorbed, the absolute amount of the fuel injection amount is large so the effect of the alcohol desorption is relatively small. In contrast, in the low load range, the absolute amount of the fuel injection amount is small, which relatively increases the effect of the alcohol desorption. As shown in FIG. 7, in this embodiment, a lower limit value of the engine load was set as kFPL so that the air fuel ratio control errors can be sufficiently suppressed with regard to the abovementioned viewpoint. When alcohol is adsorbed on the adsorbent 58 and the engine load is equal to or lower than the lower limit value kFPL, control is performed to maintain the high fuel pressure, thereby preventing the alcohol from desorbing.

Figure 7:
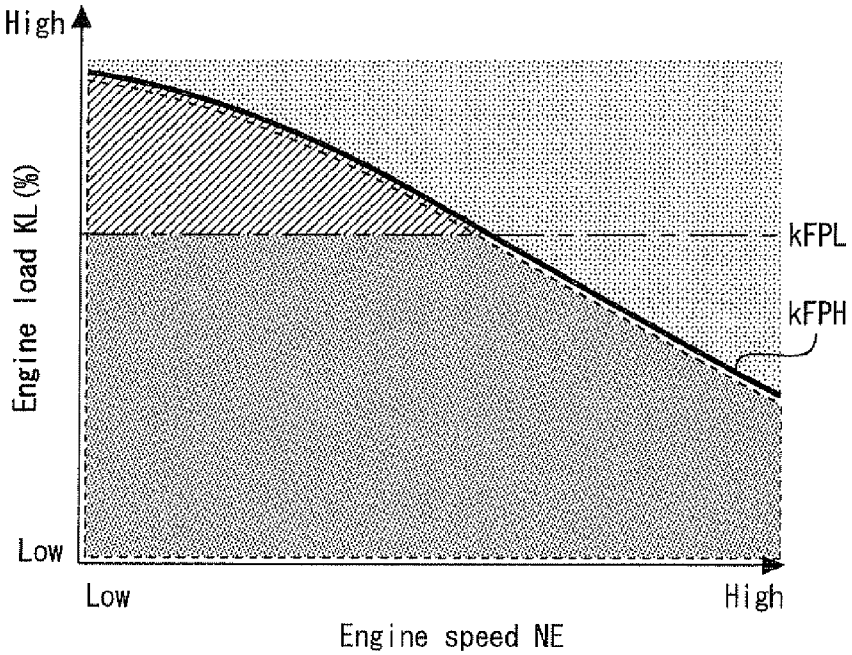
FIG. 7 is a diagram showing a range in which desorption of alcohol is permitted in a third embodiment with diagonal lines.

This embodiment combines the above two conditions together to control so that the alcohol will be desorbed from the adsorbent 58 when operating conditions (the engine speed and the engine load) of the internal combustion engine 10 are in the low-speed, high-load range indicated by the diagonal lines in FIG. 7. In the following description, reference numeral NE denotes the engine speed and reference numeral KL denotes the engine load.

Figure 8:
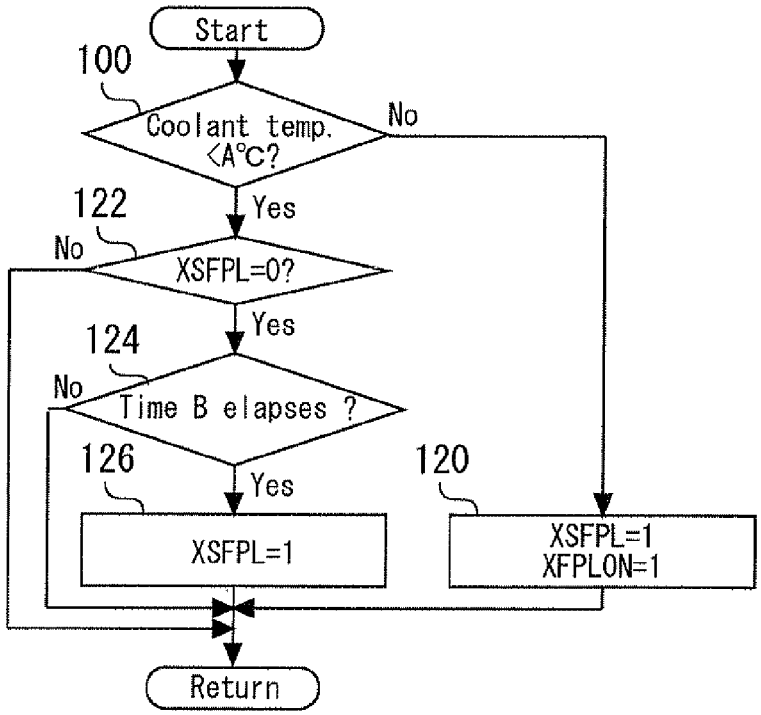
FIG. 8 is a flowchart illustrating a routine that is executed by the third embodiment of the present invention.
Figure 9:
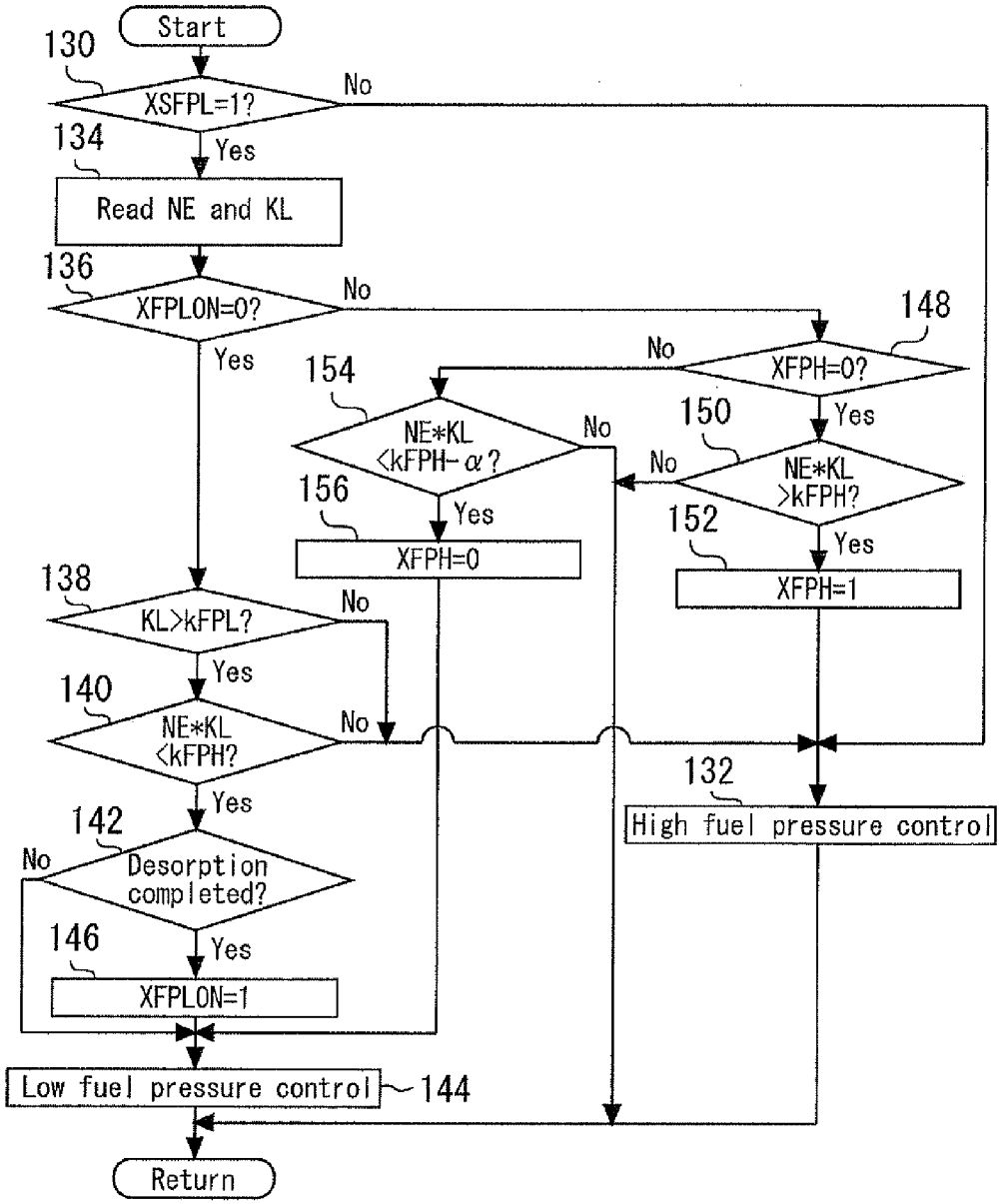
FIG. 9 is a flowchart illustrating a routine that is executed by the third embodiment of the present invention.

FIGS. 8 and 9 are flow charts showing routines performed by the ECU 50 in this embodiment in order to achieve the above-described functions. In these routines, first, the coolant temperature during starting is compared with a predetermined temperature A° C. to thereby determine whether the starting is a cold starting or warm starting (step 100 of FIG. 8). When the starting is determined to be a warm starting in step 100, the high fuel pressure control for adsorbing alcohol onto the adsorbent 58 will not be performed during the starting. The control for desorbing alcohol from the adsorbent 58 is therefore not required, either. In this case, values of both a flag XSFPL and a flag XFPLON are set to 1 (step 120).

The default values of the flag XSFPL and the flag XFPLON are both 0. When the flag XSFPL is set to 1, it indicates that desorption of alcohol is required. When the flag XFPLON is set to 1, it indicates that desorption of alcohol has completed. As will be described later, in the routine shown in FIG. 9, when the values of both the flag XSFPL and the flag XFPLON are set to 1, it is determined that adsorption and desorption of the alcohol are completed and operation proceeds to normal fuel pressure control. The process of step 120 is for setting the values of both the flag XSFPL and the flag XFPLON to 1 for convenience, in order that normal fuel pressure control will be performed from the beginning when the high fuel pressure control for adsorbing the alcohol onto the adsorbent 58 is not performed during starting.

When the starting is determined to be a cold starting in step 100, it is next determined whether the value of the flag XSFPL is 0 (step 122). When the value of the flag XSFPL is determined to be 0, then whether the elapsed time after starting has reached the predetermined period of time B is determined (step 124). If the elapsed time after starting has reached the predetermined period of time B, warm-up of the internal combustion engine 10 or the catalyst 15 would have progressed to some degree. It can be determined that desorption of the alcohol from the adsorbent 58 would not produce any adverse effect in terms of operation of the internal combustion engine 10 and the amount of HC emissions into the atmosphere. Thus, when it is determined in step 124 that the elapsed time after starting has reached the predetermined period of time B, the flag XSFPL that indicates requirement for alcohol desorption is set to 1 (step 126).

In step 130 of FIG. 9, the status of the flag XSFPL is determined. When the value of the flag XSFPL is 0, the internal combustion engine 10 and the catalyst 15 are yet to be sufficiently warmed up and the alcohol should remain adsorbed on the adsorbent 58. Therefore, regardless of the engine speed NE or the engine load KL, the high fuel pressure control is performed in all operating ranges (step 132).

On the other hand, when it is determined in step 130 that the value of the flag XSFPL is 1, it can be determined that conditions for desorbing the alcohol are satisfied in terms of the warm-up states of the internal combustion engine 10 and the catalyst 15. In this case, the current engine speed NE and the current engine load KL are next read (step 134), and subsequently the status of the flag XFPLON is determined (step 136).

Before the desorption of alcohol is completed, the value of the flag XFPLON is the default value 0. When it is determined in step 136 that the value of the flag XFPLON is 0, a process is performed as follows for determining whether the operating condition of the internal combustion engine 10 falls within the range shaded with the diagonal lines in FIG. 7. First, whether the engine load KL is higher than the lower limit value kFPL in FIG. 7 is next determined (step 138). When it is determined in step 138 that the engine load KL is equal to or lower than the lower limit value kFPL, the operating condition of the internal combustion engine 10 falls outside the range shaded with the diagonal lines in FIG. 7, so it can be determined that the alcohol should not be desorbed. In this case, the high fuel pressure control is performed (step 132).

When it is determined in step 138 that the engine load KL is higher than the lower limit value kFPL, next, whether a current operating point defined by the engine speed NE and the engine load KL is below the curve kFPH in FIG. 7 is determined (step 140). When it is determined in step 140 that the operating point defined by the engine speed NE and the engine load KL falls within the range over the curve kFPH, the operating condition of the internal combustion engine 10 does not fall within the range shaded with the diagonal lines in FIG. 7. It can be determined that the alcohol should not be desorbed. Thus, in this case, the high fuel pressure control is performed (step 132).

On the other hand, when it is determined in step 140 that the operating point defined by the engine speed NE and the engine load KL is below the curve kFPH in FIG. 7, it can be determined that the operating condition of the internal combustion engine 10 falls within the range shaded with the diagonal lines in FIG. 7. In this case, whether the desorption of alcohol has completed is next determined (step 142). When it is determined that the desorption of alcohol is yet to be completed, the low fuel pressure control is performed (step 144). The fuel pressure decreases and the alcohol desorbs from the adsorbent 58.

Incidentally, in step 142, a determination for determining whether the desorption of alcohol has completed may be done by, for example, determining whether a sufficient amount of time has elapsed. Specifically, performance time of the low fuel pressure control is added up, and when the total time exceeds a predetermined time, it can be determined that the desorption of the alcohol has completed. When it is determined in step 142 that the desorption of the alcohol is completed, the value of the flag XFPLON is set to 1 (step 146). When the value of the flag XFPLON is set to 1, the determination in step 136 will be in the negative in the next and subsequent performances, and the processes of step 148 and the followings are performed. The processes of step 148 and the followings are the normal fuel pressure control as will be described hereunder. Incidentally, as described earlier, when the high fuel pressure control for adsorbing the alcohol on the adsorbent 58 is not performed during the starting, the values of the flag XSFPL and the flag XFPLON are set to 1 from the beginning, so the normal fuel pressure control of step 148 and the followings is performed from the first time.

In the normal fuel pressure control, the status of a high fuel pressure flag XFPH that indicates whether the high fuel pressure control is being performed is first determined (step 148). When, in step 148, the value of the high fuel pressure flag XFPH is 0, i.e., when it is determined that the high fuel pressure control is not being performed, it is next determined whether the current operating point defined by the engine speed NE and the engine load KL is above the curve kFPH in FIG. 7 (step 150). When it is determined in step 150 that the current operating point is above the curve kFPH in FIG. 7, it can be determined that the operation is in the high-speed, high-load range, and so a high fuel pressure is required. In this case, the value of the high fuel pressure flag XFPH is set to 1 (step 152) and the high fuel pressure control is performed (step 132).

When the value of the high fuel pressure flag XFPH is set to 1, the determination in step 148 is in the negative. When the determination in step 148 is in the negative, it is next determined whether the current operating point defined by the engine speed NE and the engine load KL is below a line that is lower than the curve kFPH by a predetermined value a shown in FIG. 7 (step 154). The reason for comparing with a value subtracted by the predetermined value a is to prevent hunting by giving hysteresis. When it is determined in step 154 that the current operating point is on or above the line that is lower than the curve kFPH by the predetermined value a shown in FIG. 7, it can be determined that the operation in the high-speed, high-load range is continuing. In this case, the current execution of the routine directly terminates and the high fuel pressure control will be continued.

On the other hand, when it is determined in step 154 that the current operating point is below the line that is lower than the curve kFPH by the predetermined value $\alpha$ in FIG. 7, it is regarded that the operation shifted into the range lower than the high-speed, high-load range. This eliminates the need for a high pressure, so the value of the high fuel pressure flag XFPH is set to 0 (step 156) and the low fuel pressure control is performed (step 144).

According to the control of this embodiment described above, when alcohol is required to be desorbed from the adsorbent 58, it can be desorbed by selecting timing at which the operating point enters the low-speed, high-load range where inconveniences associated with the alcohol desorption are unlikely to occur. Inconveniences associated with the alcohol desorption, specifically, problems such as occurrence of control error for the air-fuel ratio and the fuel injection time not falling within the limit can therefore by reliably avoided.

The range shaded with the diagonal lines in FIG. 7 in the third embodiment described above corresponds to the "predetermined range" in the eighth aspect of the present invention. Performance of the processes of the routines shown in FIGS. 8 and 9 by the ECU 50 achieves the sixth aspect of the present invention.

Fourth Embodiment

A fourth embodiment of the present invention will be described below with reference to FIG. 10. Differences from the embodiments described above will be mainly described and descriptions of similarities will be simplified or omitted.

Figure 10:
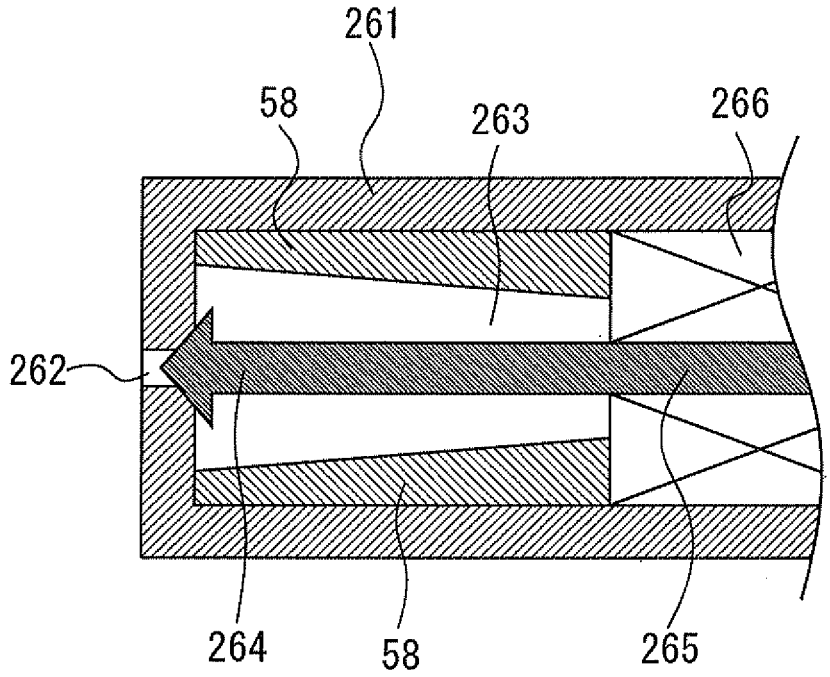
FIG. 10 is an enlarged cross-sectional view showing a leading end portion of a fuel injector.

FIG. 10 is an enlarged cross-sectional view showing a leading end portion 261 of a fuel injector 26 of this embodiment. As shown in FIG. 10, an adsorbent 58 of this embodiment is formed to be relatively thicker at positions farther from an injection nozzle 262 and relatively thinner at positions closer to the injection nozzle 262. As a result, an existing amount (existing density) of the adsorbent 58 is relatively large at a position farther from the injection nozzle 262 and relatively small at a position closer to the injection nozzle 262. Therefore, a relatively large amount of alcohol is adsorbed on the adsorbent 58 at positions farther from the injection nozzle 262 and a relatively small amount of alcohol is adsorbed on the adsorbent 58 at positions closer to the injection nozzle 262. With such arrangement, the following advantages can be achieved.

When a needle valve 264 is lifted to open the injection nozzle 262 during fuel injection, the pressure inside an internal space 263 drops instantaneously. At this time, the pressure at a position near the injection nozzle 262 especially tends to decrease. Thus, when fuel is injected in a state where alcohol is adsorbed on the adsorbent 58, part of the alcohol adsorbed on the adsorbent 58 at a position near the injection nozzle 262 may desorb. In such cases, the effect of reducing the alcohol concentration of the injected fuel may be degraded.

In contrast, in this embodiment, the adsorbent 58 has a smaller alcohol adsorption capacity at a position closer to the injection nozzle 262 relative to that of a position farther from the injection nozzle 262. The amount of alcohol adsorbed at a position closer to the injection nozzle 262 will therefore be small. As a result, the amount of alcohol desorbing will be small when the injection nozzle 262 is opened and the pressure at a position near the injection nozzle 262 decreases. The effect of reducing the alcohol concentration of the injected fuel can be reliably prevented from being degraded.

Fifth Embodiment

A fifth embodiment of the present invention will be described below with reference to FIG. 11. Differences from the embodiments described above will be mainly described and descriptions of similarities will be simplified or omitted.

Figure 11:
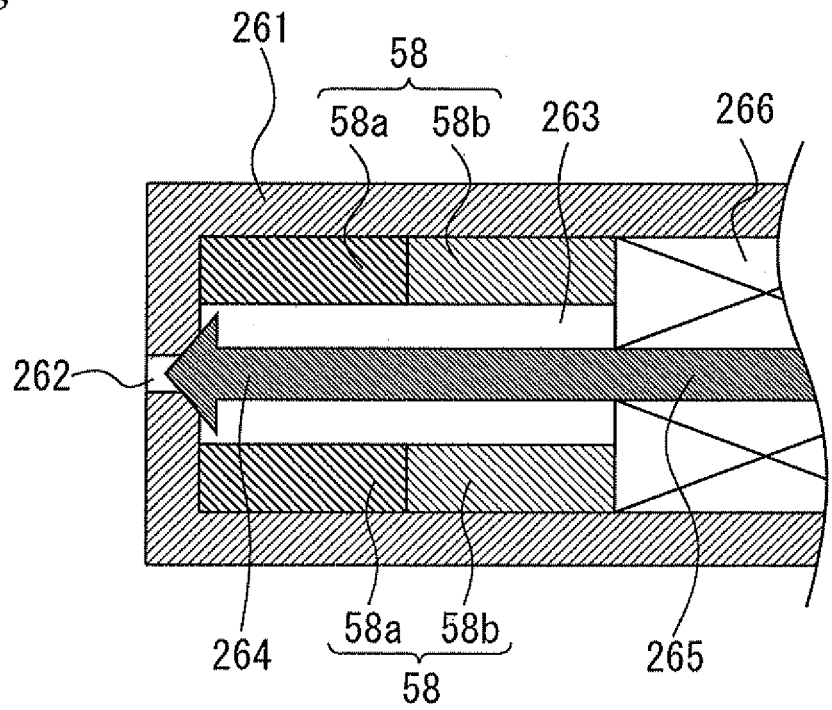
FIG. 11 is an enlarged cross-sectional view showing a leading end portion of a fuel injector.
Figure 12:
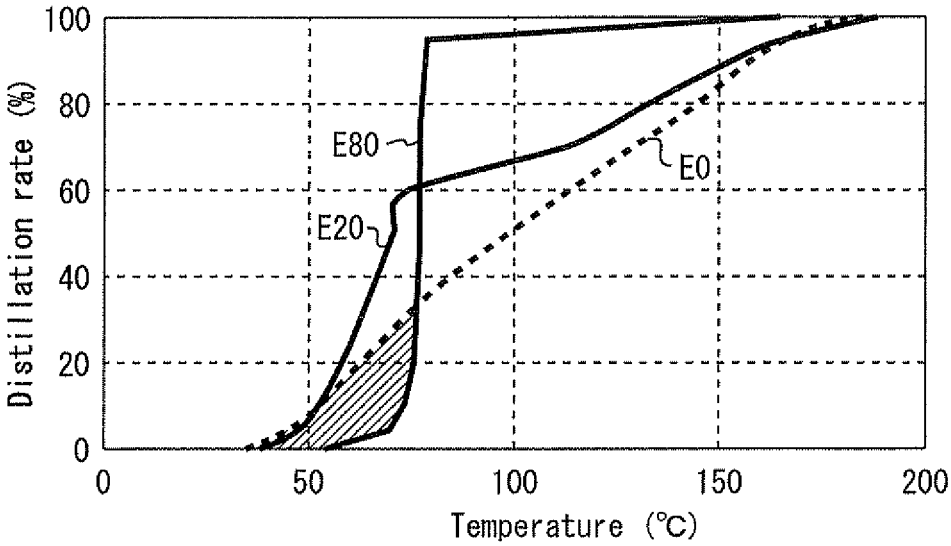
FIG. 12 is a chart showing a relationship between a distillation rate and a temperature of E80, E20, and E0.

FIG. 11 is an enlarged cross-sectional view showing a leading end portion 261 of a fuel injector 26 according to this embodiment. As shown in FIG. 11, an adsorbent 58 of this embodiment includes an adsorbent 58*a* that is disposed at a position relatively close to an injection nozzle 262, and an adsorbent 58*b* disposed at a position farther from the injection nozzle 262 than the adsorbent 58*a*. A material having a low alcohol adsorption ability (a small adsorption amount) is selected for the adsorbent 58*a* compared to a material used for the adsorbent 58*b*. Therefore, the adsorbent 58*b* disposed at a position farther from the injection nozzle 262 has a relatively large alcohol adsorption capacity, while the adsorbent 58*a* disposed at a position closer to the injection nozzle 262 has a relatively small alcohol adsorption capacity. Thus, in this embodiment, the same effect as that achieved in the above-described fourth embodiment can be achieved.

DESCRIPTION OF REFERENCE NUMERALS

10 internal combustion engine
11 intake port
12 intake path
14 exhaust path
15 catalyst
16 air flow meter
18 throttle valve
24 accelerator position sensor
26 fuel injector
261 leading end portion
262 injection nozzle
263 internal space
264 needle valve
265 plunger
266 solenoid coil
28 intake valve
30 ignition plug
32 exhaust valve
42 coolant temperature sensor
50 ECU
52 fuel tank
54 fuel supply path
56 delivery pipe
58 adsorbent

The invention claimed is:

1. A fuel injection apparatus for an internal combustion engine, comprising:

a fuel injector having a leading end portion that has an internal space in which fuel is pooled and an injection nozzle for injecting fuel; and an adsorbent disposed in the internal space, the adsorbent being capable of selectively adsorbing an alcohol component in a blended fuel of gasoline and alcohol.

2. The fuel injection apparatus for an internal combustion engine according to claim 1, wherein:

the adsorbent has a characteristic such that an amount of alcohol adsorption is small when a fuel pressure is low and large when the fuel pressure is high.

3. The fuel injection apparatus for an internal combustion engine according to claim 1, further comprising:

means for controlling adsorption of alcohol onto, and desorption of alcohol from, the adsorbent by changing a fuel pressure in the internal space.

4. The fuel injection apparatus for an internal combustion engine according to claim 1, further comprising:

means for determining whether or not there is a requirement for lowering an alcohol concentration of a fuel to be injected from the fuel injector than an alcohol concentration of a fuel supplied to the fuel injector; and means for letting the adsorbent adsorb alcohol when it is determined that there is the requirement.

5. The fuel injection apparatus for an internal combustion engine according to claim 1, further comprising:

means for, upon cold starting of the internal combustion engine, making an alcohol concentration of a fuel to be injected from the fuel injector lower than an alcohol concentration of a fuel supplied to the fuel injector by adsorbing alcohol on the adsorbent.

6. The fuel injection apparatus for an internal combustion engine according to claim 1, further comprising:

determining means for determining, based on a condition of the internal combustion engine, whether an permission condition for permitting desorption of alcohol from the adsorbent holds; and desorption control means for maintaining a condition in which alcohol is adsorbed on the adsorbent when it is determined that the permission condition does not hold, and desorbing alcohol from the adsorbent when it is determined that the permission condition holds.

7. The fuel injection apparatus for an internal combustion engine according to claim 6, further comprising:

fuel cut means for performing fuel cut of the internal combustion engine when a predetermined fuel cut condition holds, wherein:

the permission condition includes that the fuel cut is being performed.

8. The fuel injection apparatus for an internal combustion engine according to claim 6, wherein:

the permission condition includes that an engine speed and an engine load fall within a predetermined range.

9. The fuel injection apparatus for an internal combustion engine according to claim 8, wherein:

the predetermined range is a range on a low speed side and a high load side.

10. The fuel injection apparatus for an internal combustion engine according to claim 1, wherein:

the adsorbent has a smaller alcohol adsorption capacity at a position closer to the injection nozzle compared to that of a position farther from the injection nozzle.

11. The fuel injection apparatus for an internal combustion engine according to claim 10, wherein:

the adsorbent is small in quantity at a position closer to the injection nozzle compared to that at a position farther from the injection nozzle.

12. The fuel injection apparatus for an internal combustion engine according to claim 10, wherein:

a portion of the adsorbent closer to the injection nozzle is formed from a material having a low alcohol adsorption ability compared to that of a material used for a portion of the adsorbent farther from the injection nozzle.

13. The fuel injection apparatus for an internal combustion engine according to claim 1, wherein:

the adsorbent is disposed cylindrically along an inner periphery of the leading end portion of the fuel injector.

* * * * *